United States Patent [19]

Augis et al.

[11] 4,307,360

[45] Dec. 22, 1981

[54] SEALED ELECTRICAL CONTACTS

[75] Inventors: Jacques A. Augis, Pickerington; Lon L. Hines, Reynoldsburg, both of Ohio

[73] Assignee: Bell Telephone Laboratories, Incorporated, Murray Hill, N.J.

[21] Appl. No.: 71,304

[22] Filed: Aug. 30, 1979

[51] Int. Cl.[3] ..... H01H 1/54; H01H 1/02

[52] U.S. Cl. ..... 335/154; 200/266; 200/270; 335/196

[58] Field of Search ..... 335/154, 151, 196; 200/268, 269, 270, 267, 266

[56] References Cited

U.S. PATENT DOCUMENTS

| | | | |
|---|---|---|---|
| 3,222,486 | 12/1965 | Moriyama et al. | 200/266 |
| 3,663,777 | 3/1972 | Steinmetz et al. | 200/270 |
| 4,128,823 | 12/1978 | Tanaka et al. | 335/196 |

OTHER PUBLICATIONS

IEEE Publication, Mar. 1978, vol. CHMT-1, No. 1, pp. 46–53.

*Primary Examiner*—Harold Broome
*Attorney, Agent, or Firm*—Walter G. Nilsen

[57] ABSTRACT

A new type of electrical contact is described which has reduced erosion and sticking failures and has reduced material costs. The electrical contact is particularly suitable for sealed electrical contacts such as in sealed remreed contacts.

8 Claims, 2 Drawing Figures

SEALED ELECTRICAL CONTACTS

TECHNICAL FIELD

The invention involves devices with electrical contacts.

BACKGROUND OF THE INVENTION

Sealed electrical contacts form an important class of electrical contacts extensively used in electronic devices, electrical networks and the like. Since sealed electrical contacts are not exposed to the outside atmosphere, failures due to corrosive atmosphere or oxidation are greatly reduced. However, it is desirable to increase reliability and lifetime at higher switching currents and reduce failures due to organic or carbonaceous contaminants. Also of importance is the increased life of sealed contacts exposed to erosion due to cable discharges. In addition, it is desirable to simplify manufacture and reduce costs of materials without sacrificing operational characteristics and reliability.

An important class of sealed contacts is the reed contact. These types of contacts are often referred to as reed switches and reed relays. They are made of thin metal strips or reeds located in a (generally) inert atmosphere of a sealed envelope. The envelope is generally made of glass. Typically, the reeds enter into the envelope from opposite ends. The reeds are long enough to partially overlap one another and form electrical contacting surfaces. A means is provided for opening and closing the reed contacts. Most often, the reed is made of some resilient magnetic material and a magnetic field is used to move the reeds so that contact is made.

It is advantageous to have electrical contacts in these reed switches that are reliable and will continue to work reliably over long periods of time. In addition, reliable operation is desirable even where high currents and low voltages are used. Electrical contacts are also exposed to erosion from cabled discharges as well as failures from contact sticking. Reduction of the frequency of these failure modes and reduction in the cost of these devices are highly desirable. Typical reed switches are described by S. S. Coffin et al, U.S. Pat. No. 3,495,061 issued Feb. 10, 1970. The use of sputtered ruthenium as a contact material is described by J. A. Augis and L. L. Hines in *I. E. E. E. Transactions Vol. CHMT*-1 *No.* 1, March 1978, pages 46–53.

SUMMARY OF THE INVENTION

The invention is a device with at least one sealed electrical contact with a specific type of structure. This structure involves the use of copper (either solid or a film) as a base metal and ruthenium as the overlayer or contact metal. The thickness of the ruthenium layer may vary over large limits, typically from 0.3 to 10.0 μm but preferred thicknesses vary from 0.5 to 1.5 μm. This range of thicknesses insures sufficient ruthenium so that reasonable erosion due to arcing will not penetrate beyond the ruthenium layer. Excessively thick ruthenium layers are expensive and require long fabrication times and also do not conduct heat away from the contact area in an optimum manner. Good thermal conductivity from contact area into the copper and other parts of the device reduces erosion due to arcing. The electrical contact is made by a variety of techniques but sputtering particularly of the ruthenium yields exceptionally good results. The underlying copper surface may be solid copper or a copper film produced in a variety of ways including electroplating but sputtering onto a substrate material (generally a magnetic reed for a remreed switch) is most convenient. A variety of sputtering techniques may be used including dc sputtering, triode sputtering, radio-frequency sputtering and magnetron sputtering.

DETAILED DESCRIPTION

Figure 1:
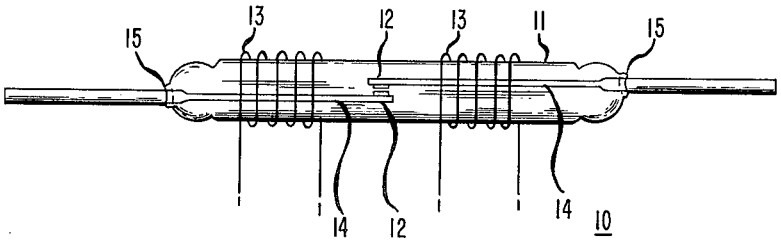
FIG. 1 shows a side view of a typical magnetically-operated sealed electrical contact made in accordance with the invention.

In its broadest terms, the invention is an electrical contact structure with copper as a base metal and ruthenium as the contact metal. The copper may form the entire base structure but more often a copper layer is put down onto another conductive substrate. This conductive substrate is often magnetic so as to form a magnetically actuated switch or relay. This electrical contact structure is most suitable for sealed electrical contacts and to sealed contact switches that are magnetically controlled.

The contact structure is most useful in a switch with a pair of relatively movable magnetic reed elements positioned to overlap one another. The overlapping portions of the reeds are enclosed in an envelope containing an inert gas. Various inert gases may be used including mixtures of hydrogen and other inert gases such as nitrogen. Typical mixtures are one-to-five weight percent hydrogen, remainder nitrogen. The magnetic reeds may be made of a variety of magnetic substances including nickel-iron alloys, alloys containing approximately 45–55 percent cobalt, 2 to 5 percent vanadium and the balance iron, remendur, etc. Such remreed switches have been described in detail in two articles, one by W. E. Archer, et al, *Bell System Technical Journal* 55, 511 (1976) and another by T. G. Grau et al, *Bell System Technical Journal* 55, 663 (1976).

A particularly suitable procedure for fabricating these contact surfaces involves sputtering both the copper and ruthenium layers onto the substrate. A dc magnetron sputtering procedure is preferred. Various carrier gases may be used but an inert gas is preferred and argon most preferred because of inertness, availability and atomic weight provides sufficient momentum for reasonable sputtering rates.

Prior to sputtering, the reed paddles (e.g., remendur reed paddles) are loaded into a water cooled holder. The reeds and holder are then placed in a freon vapor degreaser for 5 minutes and then immediately placed in a vacuum system.

The vacuum system is pumped down to a pressure of about $10^{-7}$ torr and argon is leaked into the system until the pressure is approximately 30 millitorrs. The reeds and holders are sputter cleaned for 30 minutes and then the target is presputtered on a shutter for five minutes. The copper is then sputtered to a thickness of approximately 1.0 to 1.5 μm. The reeds and holders are allowed to cool, generally for about one hour and the vacuum system vented so that the copper target can be replaced with a ruthenium target. The ruthenium is then sputtered by first pumping down the vacuum system to a pressure of about 30 millitorrs, sputter cleaning the reeds for 5 minutes, presputtering the ruthenium target onto a shutter for 5 minutes, and then sputtering the reeds to a thickness of about 0.5 to 0.8 μm. The reeds are allowed to cool, generally for about an hour and then removed from the vacuum system.

The glass bottles for sealing the contacts are ultrasonically cleaned for 5 minutes in a solution of a conventional glassware cleaner heated to 110 degrees F. The glass is then rinsed in a continuous flowing water bath for two hours. Finally, after a last rinse in distilled water, the glass is dried at 150 degrees C., for one hour.

The reeds are then sealed in the clean glass bottles with an infrared sealing machine. An atmosphere of inert dry gas (nitrogen in this case) is left inside the glass envelope. The sealed contacts are cleaned and the exposed reed shanks tinned with solder.

Because the hardness of the ruthenium is greater than that of the hardened gold contact, adjustments in the gap and overlap must be made. Typical values are gap spacing between 3 and 6 mils and overlap of 17 to 22 mils (force between 3.2 and 4.2 g). This contact structure is particularly advantageous for sealed electrical contacts especially with magnetic paddles. Such contact structures exhibit lower erosion per arcing operation, reduced arcing and better resistance stability due to foreign element contamination.

Extensive testing was carried out on remreed switches made in accordance with the invention. For comparison, similar tests were carried out on remreed sealed switches with hard gold electrical contacts. Three types of tests were carried out. The first set of tests involved switching a low energy resistive circuit. The second set of tests involved switching standard cable discharges. The third set of tests were carried out on a high energy resistive circuit. These life tests measure the wear of the contact finish. Two modes of failure occurred; resistance failure and sticking failure. Resistance failure occurs either from a build-up of contaminant in the electrode gap or wearout of the contact material so that base metal is exposed. Sticking failures involve failure of the electrical contact to open.

In the low energy resistive circuit tests the electrical contact makes and breaks a resistive circuit carrying a current of 10 milliamps with a voltage of 5 volts. After 1,000,000 operations, approximately 20 percent of the hard gold contacts failed at the 150 milliohm level while none of the ruthenium contacts had a resistance greater than 150 milliohms. Failure of the hard gold contacts appeared to be due to a black deposit localized in the contact mating area. Analysis of the black deposit showed the presence of carbon, potassium and nitrogen, presumably coming from residual electrolyte. The ruthenium contacts showed only slight burnishing of the surface as revealed from scanning electron micrographs. These tests showed two distinct advantages for ruthenium contacts. First, the ruthenium contacts do not contain any residual material which might form high resistance deposits. Second, the hardness of the finish appears to extend the life of the electrical contact.

Cable discharge tests were carried out using three meters of 100 ohm cable charged to 26 volts. This is a fairly standard type of test used in the industry. Using 150 milliohm as the failure criteria, conventional hard gold switches began to show an increase in failure rate after approximately 200,000 operations. Failure was usually due to wear-out of the electrical contact presumably due to arcing. The failure rate began to peak at approximately 1½ million operations and can be fitted to a log normal failure distribution. In contrast, the same tests carried out on ruthenium contact switches made in accordance with the invention, did not show a wear-out peak even after 2½ million operations. The longer wear-out capability of the ruthenium contact appears to be due to better ability of ruthenium to sustain arc damage due to cable discharge. On inspection of the ruthenium contacts after approximately 1½ million operations showed that these sputtered surfaces tend to delocalize erosion due to arcing. Also, the greater hardness of the ruthenium surfaces tended to reduce sticking failures.

A particular problem with magnetically operated switches is sticking failures due to magnetostrictive scrubbing. Because the remendur material has a relatively high magnetorestrictive coefficient, variations in magnetic flux when the contacts are in a closed position make the two surfaces rub together and possibly weld. This phenomena causes sticking failures. In order to test the performance of remreed switches exposed to magnetostrictive scrubbing, a special test was designed which purposely introduced excessive amounts of scrubbing. In this test, each contact is scrubbed five times on the first operation, 10 times on the second operation and 5 N times on the Nth operation. After each operation, the contact is probed for release. This test was carried out on 57 ruthenium switches and 57 conventional gold plated switches. None of the ruthenium switches showed any sticking failures even after 400 consecutive scrubs (N=80) and the contact resistance of the ruthenium switch was undisturbed after a total of 4,010 scrubs. By comparison, all but one of the conventional gold plated contacts failed this test. The greater surface hardness of the ruthenium contact appears to make this contact immune to extensive scrubbing. Since sticking is conventionally reduced by introducing traces of water into the contact area, ruthenium switches can be made without such water. This permits operation over a wider temperature range. In particular, temperatures below the freezing point of water should not affect contact operation.

Life tests were also carried out under high energy conditions which involve switching a resistive circuit carrying 100 milliamps at 50 volts. Both the ruthenium switches and the conventional gold plated switches were exposed to approximately 1½ million operations. Using two types of failure criteria, namely, 150 milliohms and 1 ohm, the two types of switches showed no significant difference in failure behavior. Failure seemed to be due to a pip and crater erosion with a pattern completely different from the erosion observed with cable discharges. The failure appears to be due to chattering following the make operation. An increase in the thickness of the ruthenium layer from the 0.8 micrometers used here to approximately 1.2–1.8 micrometers might significantly decrease the failure rate obtained under high energy conditions.

FIG. 1 shows a typical magnetically actuated reed switch 10 with glass envelope 11, and contact area 12. The magnetic switch is actuated by an electrical circuit 13, which imposes a magnetic force on the magnetic reed 14. A glass to metal seal 15, is used to completely seal off the inner parts of the remreed switch.

Figure 2:
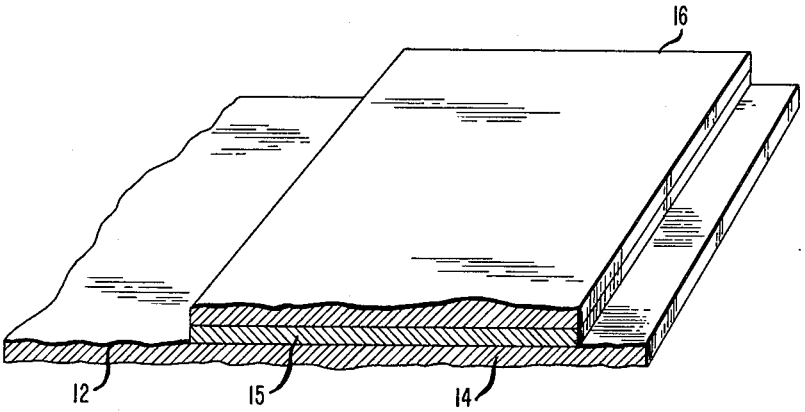
FIG. 2 shows a perspective view of the metal contact portion of a sealed electrical contact.

FIG. 2 shows a more detailed drawing of the contact area 12. The bottom layer shows the magnetic material 14, which is responsible for the motion of the switch under the influence of the magnetic force. Immediately on top of the magnetic material is a layer of copper 15, followed by a layer of ruthenium 16.

What is claimed is:

1. A device comprising a sealed electrical contact in which the contact area of the sealed electrical contact comprises a. substrate and a first layer; and b. a second layer consisting essentially of ruthenium with a thickness from 0.3 to 10.0 μm, characterized in that the first layer consists essentially of copper.

2. The device of claim 1 in which the ruthenium layer has a thickness between 0.5 and 1.5 μm.

3. The device of claim 1 in which interposed between substrate and second layer is a first layer consisting essentially of copper.

4. The device of claim 1 in which the substrate comprises magnetic material.

5. The device of claim 4 in which the substrate is remendur.

6. The device of claim 5 in which the contact area comprises substrate consisting essentially of remendur, a layer of copper followed by a layer of ruthenium.

7. The device of claim 6 in which the copper layer is sputtered onto the substrate to a thickness between 1.0 and 1.5 μm.

8. The device of claim 7 in which the ruthenium is sputtered to a thickness of 0.5 to 0.8 μm.

* * * * *